US005635025A

United States Patent [19]

Bilodeau

[11] Patent Number: 5,635,025

[45] Date of Patent: Jun. 3, 1997

[54] DIGESTER SYSTEM CONTAINING A SINGLE VESSEL SERVING AS ALL OF A CHIP BIN, STEAMING VESSEL, AND CHIP CHUTE

[75] Inventor: Victor L. Bilodeau, Queensbury, N.Y.

[73] Assignee: Ahlstrom Machinery Inc., Glens Falls, N.Y.

[21] Appl. No.: 354,005

[22] Filed: Dec. 5, 1994

[51] Int. Cl.[6] ..... D21C 7/06

[52] U.S. Cl. ..... 162/17; 162/238; 162/246

[58] Field of Search ..... 162/17, 18, 52, 162/246, 248, 238

[56] References Cited

U.S. PATENT DOCUMENTS

| | | | |
|---|---|---|---|
| 2,803,540 | 8/1957 | Durant et al. | 92/7 |
| 3,303,088 | 2/1967 | Gessner | 162/19 |
| 4,372,711 | 2/1983 | Richter et al. | 406/63 |
| 4,958,741 | 9/1990 | Johanson | 220/83 |
| 5,236,285 | 8/1993 | Prough | 406/52 |
| 5,236,286 | 8/1993 | Prough | 406/52 |
| 5,476,572 | 12/1995 | Prough | 162/246 |

FOREIGN PATENT DOCUMENTS

| | | |
|---|---|---|
| 1154622 | 10/1983 | Canada . |
| 1302764 | 6/1992 | Canada . |
| 324949 | 6/1970 | Sweden . |

OTHER PUBLICATIONS

"Continuous Pulping Processes", Sven Rydholm, Special Technical Association Publication, Stap No. 7, 1970, p. 144.

*Primary Examiner*—Donald E. Czaja
*Assistant Examiner*—Dean T. Nguyen
*Attorney, Agent, or Firm*—Nixon & Vanderhye P.C.

[57] ABSTRACT

In a continuous digester system the chip feed equipment is greatly simplified by substituting a single vertical vessel for the conventional chip bin, steaming vessel and chip chute. An outlet at the bottom of the single vessel is connected, through a low pressure pump, to the low pressure input of a high pressure transfer device which is connected to a digester (either directly or through an impregnation vessel). A metering device, preferably through a pressure isolation device for maintaining superatmospheric pressure in the vessel, feeds chips into the top of the vessel. A first level, of chips, is established in the vessel and a second, liquid, level below the first level is also established. Steam is supplied to a volume between the top of the vessel and the second level utilizing a conduit with an automatically controlled valve and a temperature controller for at least partially controlling the valve. A level controller controls the supply of liquid to the vessel and is connected to the low pressure outlet from the high pressure transfer device. There is a reduction in cross-sectional area of the vessel of greater than 50% between the second level and the outlet at the bottom of the vessel. Alternatively, the pump from the bottom of the vessel may be connected to one or more batch digesters.

23 Claims, 1 Drawing Sheet

DIGESTER SYSTEM CONTAINING A SINGLE VESSEL SERVING AS ALL OF A CHIP BIN, STEAMING VESSEL, AND CHIP CHUTE

BACKGROUND AND SUMMARY OF THE INVENTION

In the pulping of comminuted cellulosic fibrous material, such as wood chips, in a continuous or batch digester the material is treated to remove entrapped air and to impregnate the material with cooking liquor while raising its pressure and temperature (e.g. to 150° C. and 165 psi). Typically, the chips are steamed to purge them of air while simultaneously increasing their temperature, passed through air locks to raise their pressure, impregnated with heated cooking liquor, and then transported as a slurry to the digester.

In the past, in order to accommodate the purging, heating, pressurizing, and feeding functions, an apparatus is provided that is bulky, tall, and expensive. Normally a special building or super structure must be built to house or support this equipment. Such a building or super structure is built with structural steel and concrete, requires utilities, stairwells, and other accouterments, and contributes greatly to the cost of a continuous digester system. Also, the cost of the conveyor which transports chips to the inlet to the system is highly dependent upon the overall height of the system, which is typically on the order of about 115 feet for a digester which has a capacity of about 1,500 tons per day.

In U.S. Pat. No. 5,476,572 a method and apparatus are provided which utilize a delivery system which is much less massive, tall and expensive than the conventional systems. According to the present invention another variation of the approach taken in U.S. Pat. No. 5,476,572 is provided which also results in a greatly simplified chip feed system for a continuous digester, and also useful with batch digesters. According to the present invention a single generally vertical vessel, having a top and a bottom, is provided which performs the functions of a conventional chip bin, steaming vessel, and chip chute into a single vessel, typically smaller than the combined sizes of the other vessels (e.g., typically at least 20% smaller than the combined sizes), which results in a significant decrease in the cost of constructing and operating a chip feed system for a continuous digester. Even if the single vessel according to the invention is larger than corresponding prior art vessels, because of its simplicity, it is easier to construct, operate and maintain.

According to one aspect of the present invention a method of handling comminuted cellulosic fibrous material, such as wood chips, is provided to feed the material to a continuous or batch digester. The method comprises the steps of: (a) Confining comminuted cellulosic fibrous material in a predetermined, open, volume. (b) In the predetermined volume, establishing a first level of comminuted cellulosic fibrous material, and a second level, below the first level, of cooking liquor. (c) Subjecting the comminuted cellulosic fibrous material between the first and second levels to steam to effect steaming of the comminuted cellulosic fibrous material in the predetermined volume. (d) Slurrying the comminuted cellulosic fibrous material with cooking liquor below the second level, to produce a slurry in the predetermined volume. And (e) removing the slurry from the predetermined volume, further pressurizing the slurry, and feeding the pressurized slurry to a continuous or batch digester.

Preferably steps (a)–(e) are practiced substantially so continuously, comminuted cellulosic fibrous material being substantially continuously introduced into the predetermined volume from above the first level, substantially continuously flowing downwardly in the predetermined volume, and being substantially continuously removed from the predetermined volume below the second level. Steps (a)–(e) may also be practiced at superatmospheric pressure (e.g. about 0.1–4 bar). The slurry from step (e) may be fed directly to the top of a digester, or through an impregnation vessel.

According to another aspect of the present invention a digester system is provided comprising the following components: A continuous digester. A high pressure transfer device for transferring comminuted cellulosic fibrous material slurry under pressure to the continuous digester. A generally cylindrical vertically oriented vessel having a top and a bottom. Metering means for feeding comminuted cellulosic fibrous material into the vessel from the top thereof. Means for establishing a first level, of comminuted cellulosic fibrous material, in the vessel. Means for establishing a second, liquid, level in the vessel, the second level below the first level. Means for supplying steam to a volume between the top of the vessel and the second level. And means for withdrawing a slurry of comminuted cellulosic fibrous material in liquid from adjacent the bottom of the vessel and feeding the slurry to the high pressure transfer device.

The withdrawing means may comprise a combination of a metering screw feeder, or any type of conventional metering conveyor, and a low pressure pump, while the metering means may comprise a conventional chip meter such as sold by Kamyr, Inc. of Glens Falls, N.Y., a screw conveyor, or any other type of conventional metering conveyor.

The vessel may include, between the second level and the bottom of the vessel, a single convergence type configuration providing a reduced cross sectional area of more than 50% compared to the cross sectional area at the second level. A pressure isolation device is preferably provided between the metering means and the vessel to control the vessel pressure. The vessel may be operated pressurized or unpressurized.

According to yet another aspect of the present invention an upright vessel having a top and a bottom, is provided. The vessel takes the place of a conventional chip bin, steaming vessel and chip chute in a conventional system for feeding chips or like comminuted cellulosic fibrous material to a continuous digester, and preferably has a size of at least 20% less than the combined sizes of the conventional chip bin, steaming vessel and chip chute, and preferably is at least 50% smaller in size. Regardless of size, the vessel is less complex, making it easier to construct, operate and maintain. The vessel comprises: A first conduit for supplying steam to the vessel. A first automatically controlled valve in the first conduit. A temperature controller for sensing the temperature within the vessel and controlling the first valve at least partially in response thereto. A second conduit for supplying liquid to the vessel. A second automatically controlled valve associated with the second conduit. A level controller for sensing the level of liquid within the vessel and controlling the second valve at least partially in response thereto. Metering means for feeding comminuted cellulosic fibrous material into the vessel from the top thereof. And means for withdrawing a slurry of comminuted cellulosic fibrous material in liquid from adjacent the bottom of the vessel. The details of the components described above may be as set forth earlier.

According to yet another aspect of the present invention there is provided a method of simplifying the chip feed system of a continuous digester having a high pressure transfer device comprising steps of: (a) Removing the conventional chip bin, steaming vessel and chip chute from operative connection to the high pressure transfer device. (b) Replacing the chip bin, steaming vessel and chip chute with a single vertical vessel having steaming means and chip slurrying means associated therewith and having an outlet from the bottom thereof, the single vertical vessel preferably having a volume at least 20% less than the combined volumes of the chip bin, steaming vessel, and chip chute. And (c) connecting the outlet from the bottom of the single vertical vessel to the high pressure transfer device.

The invention also relates to a chips steam and feeding device for feeding steamed chips to a batch digester in an effective and simplified manner.

It is the primary object of the present invention to provide for the simplified, less expensive, yet effective feed of chips or like comminuted cellulosic fibrous material to a continuous or batch digester. This and other objects of the invention will become clear from an inspection of the detailed description of invention and from the appended claims.

DETAILED DESCRIPTION OF THE DRAWINGS

Figures 1, 2:
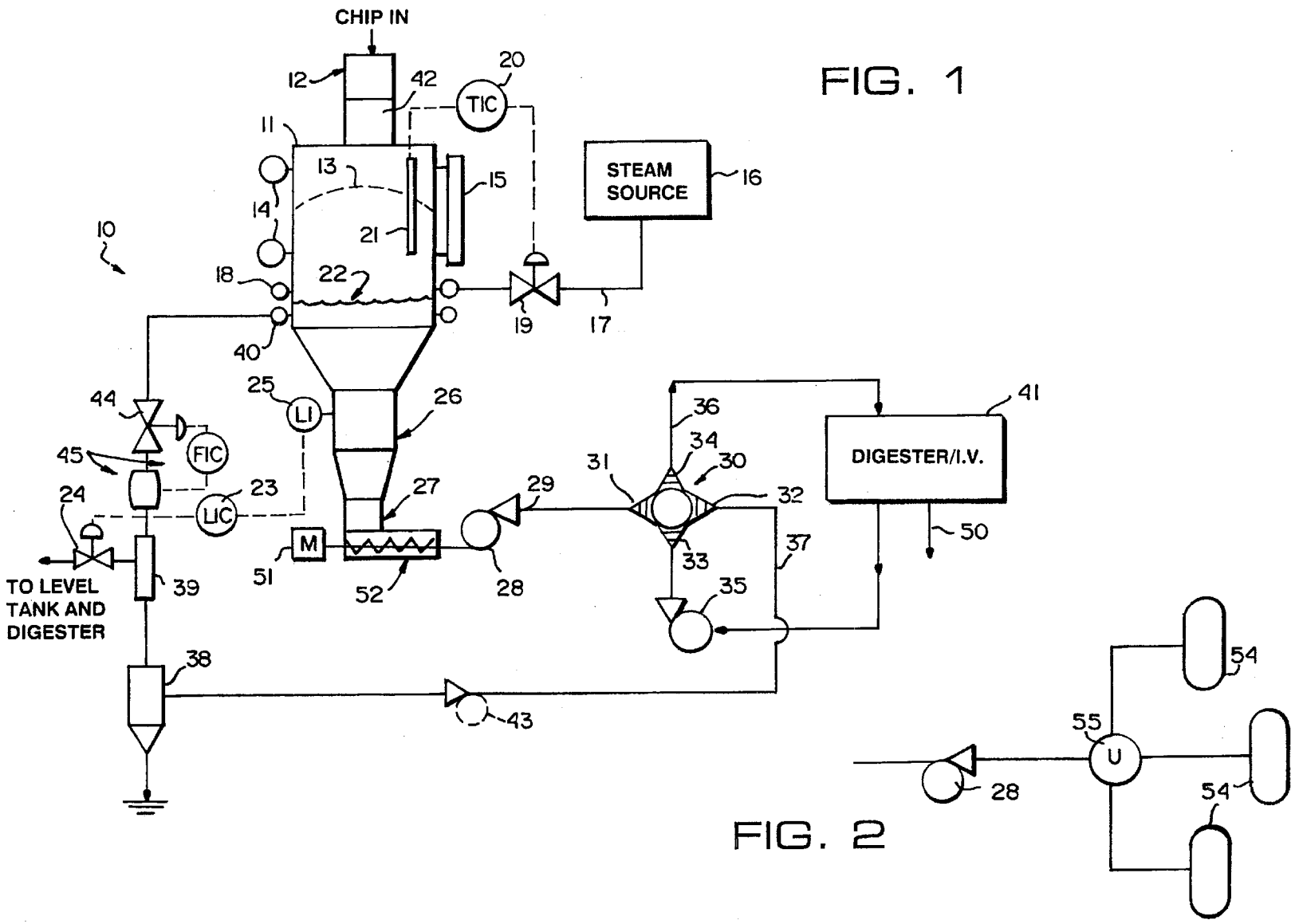
FIG. 1 is a side schematic view of an exemplary apparatus according to the invention for practicing exemplary methods according to the present invention.
FIG. 2 is a schematic view illustrating the feeding of steamed chips from the apparatus of FIG. 1 to a plurality of batch digesters.

Instead of the conventional chip bin, steaming vessel, and chip chute for feeding comminuted cellulosic fibrous material to a high pressure transfer device (also called a high pressure feeder), and as described in the prior art sections PCT Publication No. WO 96/10674 (the disclosure of which is hereby incorporated by reference herein), according to the present invention a single vessel 11 in a simplified feed system 10 (see FIG. 1) is provided. The vessel 11 is generally vertically oriented and has a top and a bottom, and may be smaller than the combined sizes of the conventional chip chute, steaming vessel and chip bin, e.g., having a size that is at least 20% less than the combined sizes of those conventional vessels, and preferably even at least 50% less in size. In any event, it is simple, being easy to construct, operate and maintain.

The vessel 11 is fed with wood chips, or like comminuted cellulosic fibrous material, utilizing a metering means 12. The metering means 12 may be a conventional chip meter as sold by Kamyr, Inc. of Glens Falls, N.Y. or it may be any type of conveyor that can be used to control the flow of chips into the system, for example a screw conveyor.

The hopper or vessel 11 may include conventional devices for venting gases and controlling the pressure and vacuum within the vessel. For example, the pressure/vacuum relief gate disclosed in copending application "Reducing Gaseous Emission from a Chip bin" Ser. No. 08,317,801 filed on Oct. 4, 1994 (Attorney Reference 10-1005), the disclosure of which is hereby incorporated by reference herein, may be used.

The metered chip flow into vessel 11 establishes a chip level 13, which is conventionally monitored by a gamma radiation system including gamma radiation sources 14, and a radiation detector 15, providing a means for establishing the first, chips, level 13 in vessel 11.

Steam from steam source 16 is added to the vessel 11 via conduit 17 and steam header 18. A typical steam addition point is shown in FIG. 1, however, steam may be added at other points or at different points if necessary or desirable. Normally the steam is added below level 13 and where the chips are open (i.e. not covered by liquid).

The flow of steam is controlled by control valve 19 which is in turn automatically controlled by the conventional temperature-indicator-controller 20. Controller 20 receives a chip temperature signal from temperature probe 21 and at least in part controls automatic valve 19 in response thereto. The temperature control may be as disclosed in said PCT Publication No. WO 96/10674.

After steaming, the chips are immersed and impregnated in cooking liquor, for example, kraft black liquor, white liquor, green liquor, or sulfite cooking liquor, at the liquor level 22. This second liquor, level 22 is controlled by conventional level-indicator-controller 23 which controls (at least in part) second control valve 24 while monitoring the liquor level via level indicator 25, the valve 24 connected to the in-line drainer 39. Mother valve 44 leading from drainer 39 back to vessel 11 is controlled by a conventional flow control system 45.

As the steamed and impregnated chips continue downwardly they encounter the transition 26 which reduces the cross-sectional area of the vessel 11 by more than 50%, so at the vessel 11 bottom the low pressure pump 28 can be fed. This transition 26 may be of single-convergence type sold under the trademark Diamondback Hopper® by J. R. Johnson of San Luis Obispo, Calif., and as shown in U.S. Pat. No. 4,958,741, or two or more of these types of hoppers may be used. This transition 26 may also be a "chisel-type" hopper, such as shown in copending application Ser. No. 08/189,546 filed Feb. 1, 1994.

A screw 52, powered by an electric motor 51, transfers a metered flow of slurry to the inlet of the pump 28. The motor 51 is preferably a variable speed motor. The screw 52 may be replaced by any suitable metering device that seprates the pump 28 from the vessel 11 so that the weight of chip mass on the pump inlet does not hinder its operation. That is any suitable chip flow restrictor, such as a conveyor, rotating table, or the like, may be used as the metering device in place of screw 52.

The pump 28 transfers the steamed and impregnated chip and liquor slurry from the bottom of the hopper to a conventional high pressure transfer device 30, via conduit 29. The pump 28 is typically a conventional slurry pump. The high pressure transfer device 30 is typically a conventional high pressure feeder as supplied by Kamyr, Inc., and such as generally shown in U.S. Pat. No. 4,372,711.

The high pressure feeder 30 shown typically has a low pressure inlet 31 and a low pressure outlet 32, a high pressure inlet 33 and a high pressure outlet 34. The chips and liquor passed to the feeder 33 via conduit 31 are substantially separated in the feeder. Substantially all the chips are transported out of the high pressure outlet 34 by means of high pressure pump 35 and pass under pressure to a continuous digester or impregnation vessel 41 via conduit 36. The liquor not passed via conduit 36 exits the feeder 30 through low pressure outlet 32. This liquor is returned to the vessel 11 by conduit 37, sand separator 38, in-line drainer 39, control valve 44, and distribution header 40.

The above discussion describes a feed system in which the feed hopper 11 is operated under substantially atmospheric pressure. However, if desired, the vessel 11 may also operate under superatmospheric conditions. In this case an additional pressure isolating device 42, such as shown in U.S. Pat. No. 5,500,083, may be located between the chip meter 12 and hopper 11. One typical device that could be used as device 42 is a low pressure feeder sold by Kamyr, Inc., though any available pressure isolating device may be used. If a pressurized vessel 11 is used, an additional pump 43, may be required to return liquor from the high pressure transfer device 30 to the pressurized vessel 11. The superatmospheric pressure maintained in vessel 11 is typically about 0.1–4 bar, e.g., 2–4 bar.

The steam source 16 may be any available steam source in the mill. For example, the steam may be fresh steam in line 50. Since steam produced from flashed cooking liquor can contain undesirable total reduced sulfur (TRS) gases which must be collected and destroyed if introduced into the hopper, fresh steam is preferred.

FIG. 2 illustrates use of the pump 28 from FIG. 1 to feed one or more batch digesters 54. Where a plurality of digesters 54 are fed, a distribution valve 55 is preferably provided to control flow from pump 28 (which is usually substantially continuous) to digester 54. A storage vessel may also be provided, especially if only a single digester 54 is used, or pump 28 and vessel 11 operation may be discontinuous.

It will thus be seen that according to the present invention advantageous methods, apparatus and systems have been provided which greatly simplify the feeding of chips to a continuous digester. While the invention has been herein shown and described in what is presently conceived to be the most practical and preferred embodiment thereof, it will be apparent to those of ordinary skill in so the art that many modifications may be made thereof within the scope of the invention, which scope is to be accorded the broadest interpretation of the appended claims so as to encompass all equivalent structures and processes.

What is claimed is:

1. A digester system, comprising:

a continuous or batch digester;

a single generally cylindrical vertically oriented vessel having a top and a bottom for receiving, steaming, and slurrying comminuted cellulosic fibrous material before feeding to said digester, functioning as all of a chip bin, steaming vessel, and chip chute;

metering means for feeding comminuted cellulosic fibrous material into said vessel from the top thereof;

means for establishing a first level, of comminuted cellulosic fibrous material, in said vessel;

means for establishing a second, liquid, level in said vessel, said second level below said first level;

means for supplying steam to a volume between said top of said vessel and said second level; and means for withdrawing a slurry of comminuted cellulosic fibrous material in liquid from adjacent the bottom of said vessel and feeding the slurry to said digester;

said digester and said single vertically oriented vessel being the only comminuted cellulosic material handling vessels of said system.

2. A digestor system as recited in claim 1 wherein said means for supplying steam comprises a first conduit operatively connected to said vessel, a first automatically controlled valve in said first conduit, and a temperature controller for sensing the temperature within said vessel and controlling said first valve at least partially in response thereto.

3. A digester system as recited in claim 2 wherein said means for establishing a second, liquid, level in said vessel comprises a second conduit for supplying liquid to said vessel, a second automatically controlled valve in said second conduit, and a level controller for sensing the level of liquid within said vessel and controlling said second valve at least partially in response thereto.

4. A digester system as recited in claim 3 wherein said vessel includes, between said second level and said bottom of said vessel, a single convergence type configuration providing a reduced cross sectional area of more than 50% compared to the cross sectional area at said second level.

5. A digester system as recited in claim 4 wherein said digester is a continuous digester, and further comprising a high pressure transfer device for transferring comminuted cellulosic fibrous material slurry under pressure to said continuous digester.

6. A digester system as recited in claim 5 further comprising a pressure isolation device between said metering means and said vessel for maintaining superatmospheric pressure within said vessel.

7. A digester system as recited in claim 6 wherein said withdrawing means comprises a metering device and a pump.

8. A digester system as recited in claim 7 wherein said means for establishing a second, liquid level in said vessel includes a recirculation line from a low pressure output of said high pressure transfer device through a sand separator and a flow controlled valve back to said vessel.

9. A digester system as recited in claim 1 wherein said means for establishing a second, liquid, level in said vessel comprises a second conduit for supplying liquid to said vessel, a second automatically controlled valve in said second conduit, and a level controller for sensing the level of liquid within said vessel and controlling said second valve at least partially in response thereto.

10. A digester system as recited in claim 1 wherein said vessel includes, between said second level and said bottom of said vessel, a single convergence type configuration providing a reduced cross sectional area of more than 50% compared to the cross sectional area at said second level.

11. A digester system as recited in claim 1 wherein said digester is a continuous digester, and wherein said means for feeding the slurry from said vessel to said digester comprises a high pressure transfer device.

12. A digester system as recited in claim 11 further comprising a pressure isolation device between said metering means and said vessel for maintaining superatmospheric pressure within said vessel.

13. A digester system as recited in claim 11 wherein said means for supplying steam comprises a first conduit operatively connected to said vessel, a first automatically controlled valve in said first conduit, and a temperature controller for sensing the temperature within said vessel and controlling said first valve at least partially in response thereto.

14. A digester system as recited in claim 11 wherein said means for establishing a second, liquid, level in said vessel comprises a second conduit for supplying liquid to said vessel, a second automatically controlled valve in said second conduit, and a level controller for sensing the level of liquid within said vessel and controlling said second valve at least partially in response thereto.

15. A digester system as recited in claim 11 wherein said vessel includes, between said second level and said bottom of said vessel, a single convergence type configuration providing a reduced cross sectional area of more than 50% compared to the cross sectional area at said second level.

16. A digester system as recited in claim 11 wherein said withdrawing means comprises a metering device and a pump.

17. A digester system as recited in claim 11 wherein said means for establishing a second, liquid level in said vessel includes a recirculation line from a low pressure output of said high pressure transfer device through a sand separator and a flow controlled valve back to said vessel.

18. A digester system as recited in claim 1 wherein said withdrawing means comprises a metering device and a pump.

19. A digester system as recited in claim 1 wherein said means for establishing a second, liquid level in said vessel includes a recirculation line from a low pressure output of said high pressure transfer device through a sand separator and a flow controlled valve back to said vessel.

20. A digester system as recited in claim 1 wherein said digester comprises a plurality of batch digesters; and wherein said means for feeding the slurry to said digester comprises a distribution valve for alternatively feeding slurry to each of said batch digesters.

21. A digester system as recited in claim 1 wherein said vessel includes, between said second level and said bottom of said vessel, a transition portion which reduces the cross-sectional area of the vessel by more than 50% compared to the cross-sectional area at said second level.

22. A digester system as recited in claim 21 wherein said transition comprises a chisel-type hopper.

23. A digester system comprising:

a continuous digester;

an impregnation vessel connected to said continuous digester;

a single generally cylindrical vertically oriented vessel having a top and a bottom for receiving, steaming, and slurrying comminuted cellulosic fibrous material before feeding to said digester, functioning as all of a chip bin, steaming vessel, and chip chute;

metering means for feeding comminuted cellulosic fibrous material into said vessel from the top thereof;

means for establishing a first level, of comminuted cellulosic fibrous material, in said vessel;

means for establishing a second, liquid, level in said vessel, said second level below said first level;

means for supplying steam to a volume between said top of said vessel and said second level; and means for withdrawing a slurry of comminuted cellulosic fibrous material in liquid form from adjacent the bottom of said vessel and feeding the slurry to said impregnation vessel, said slurry withdrawing and feeding means including a high pressure feeder; wherein said vessel includes, between said second level and said bottom of said vessel, a transition portion comprises a transition with single convergence and side relief, or a chisel-type hopper, which reduces the cross-sectional area of the vessel by more than 50% compared to the cross-sectional area at said second level.

* * * * *